US005131768A

United States Patent [19]

Shimura et al.

[11] Patent Number: 5,131,768

[45] Date of Patent: Jul. 21, 1992

[54] REPLENISHING AN INK TRANSFER SHEET

[75] Inventors: Hidetsugu Shimura; Hajime Kurihara, both of Suwa, Japan

[73] Assignee: Seiko Epson Corporation, Tokyo, Japan

[21] Appl. No.: 573,961

[22] Filed: Aug. 28, 1990

Related U.S. Application Data

[60] Continuation-in-part of Ser. No. 483,834, Feb. 23, 1990, Pat. No. 5,090,828, which is a division of Ser. No. 312,000, Feb. 17, 1989, Pat. No. 4,942,056.

[30] Foreign Application Priority Data

Aug. 29, 1989 [JP] Japan ..... 1-222031
Aug. 29, 1989 [JP] Japan ..... 1-222032

[51] Int. Cl.[5] ..... B41J 27/16

[52] U.S. Cl. ..... 400/202; 400/198; 400/202.4; 400/197; 427/14.1; 427/25; 427/141

[58] Field of Search ..... 400/198, 197, 200, 201, 400/202, 202.2, 202.4; 101/DIG. 37; 427/14.1, 25, 141

[56] References Cited

U.S. PATENT DOCUMENTS

| | | | |
|---|---|---|---|
| 4,220,699 | 9/1980 | Ishida | 430/126 |
| 4,253,775 | 1/1981 | Crooks | 400/198 |
| 4,296,176 | 10/1981 | Lennon | 428/407 |
| 4,419,024 | 12/1983 | Bowlds | 400/120 |
| 4,421,429 | 12/1983 | Graham | 400/120 |
| 4,467,332 | 8/1984 | Akutsu | 346/140 R |
| 4,606,990 | 8/1986 | Yoshikama | 430/122 |
| 4,847,110 | 7/1989 | Nakajima | 427/25 |
| 4,877,341 | 10/1989 | Cherbuy | 400/119 |
| 4,882,593 | 11/1989 | Touma | 346/111 |
| 4,976,986 | 12/1990 | Akutsu | 427/27 |

FOREIGN PATENT DOCUMENTS

| | | | |
|---|---|---|---|
| 3432508 | 3/1985 | Fed. Rep. of Germany | 427/14.1 |
| 126475 | 9/1980 | Japan | 400/198 |
| 18284 | 2/1983 | Japan | 400/198 |
| 67492 | 4/1983 | Japan | 400/198 |
| 82264 | 5/1983 | Japan | 427/14.1 |
| 84786 | 5/1983 | Japan | 400/198 |
| 134778 | 8/1983 | Japan | 400/198 |
| 59-155971 | 9/1983 | Japan . | |
| 155984 | 9/1983 | Japan | 400/198 |
| 59-208073 | 12/1983 | Japan . | |
| 259485 | 12/1985 | Japan | 400/198 |

*Primary Examiner*—Edgar S. Burr
*Assistant Examiner*—Eric Raciti
*Attorney, Agent, or Firm*—Kaplan Blum

[57] ABSTRACT

A method and apparatus for replenishing depleted portions of an ink layer of an ink sheet formed with a conductive ink layer disposed on an insulating layer from which ink has been transferred, without unintentionally supplying ink to undepleted portions of the ink layer are provided. Electrically conductive replacement ink is charged and supplied onto an intermediate transfer roller having a dielectric layer disposed on an electrically conductive layer. Charge is supplied to the insulating layer side of the ink sheet and replacement ink on the intermediate roller contacting the ink sheet at depleted regions of the ink sheet is transferred from the intermediate roller to the depleted portions by electrostatic attraction and not to undepleted portions. The method and apparatus are adaptable for multi-color ink sheets and can be employed in connection with a printer or image forming device.

47 Claims, 9 Drawing Sheets

REPLENISHING AN INK TRANSFER SHEET

This application is a Continuation-In-Part of application Ser. No. 07/483,834, filed Feb. 23, 1990, now U.S. Pat. No. 5,090,828 which is a division of application Ser. No. 07/312,000, filed Feb. 17, 1989, now U.S. Pat. No. 4,942,056.

BACKGROUND OF THE INVENTION

The invention relates generally to a method for regenerating or replenishing an ink sheet that is used for heat-transfer printing and more particularly to a method and apparatus for electrostatically supplying replacement ink to depleted portions of an ink layer from which ink has been transferred during printing.

Conventional methods for regenerating a depleted ink sheet include direct ink layer regenerating in which hot-melt ink is melted and the melted ink is applied to a depleted ink sheet. An example of this method is described in SID 1985 Digest, pages 143-145. However, direct ink regenerating has drawbacks. Considerable time is necessary for warm-up to occur while the ink in a storage container is melted. A large amount of electricity is needed to maintain the replacement in a molten state. This method is also inefficient because replacement ink cannot be supplied selectively to only the depleted portions. Rather, the entire ink layer is continuously regenerated and mechanisms are required to maintain proper and constant ink layer thickness. Additional mechanisms are required to remove melted ink from the ink sheet after power is turned off and maintenance of the apparatus can be complicated.

A method of replenishing an ink sheet that uses powdered ink is described in Japanese Application No. 31332/88. Another is described in U.S. Pat. No. 4,467,332 in which powdered ink is transferred from the surface of an electrode to primarily depleted portions of the ink layer of the ink sheet. However, this method also has shortcomings because powdered ink will unintentionally adhere to undepleted portions of the ink sheet. Although the amount of ink adhering to the recorded and unrecorded portions of the ink layer can be substantially controlled, distributions of electric potential appear at the interface between depleted portions and undepleted portions of the ink layer. This phenomenon is referred to as the edge effect and adhesion of powdered ink at the vicinity of the interface will increase. This leads to an uneven ink layer and can lead to additional problems when attempting to adjust the thickness of the regenerated ink layer.

Accordingly, it is desirable to develop an improved method and apparatus for replenishing an ink sheet which avoids the shortcomings of the prior art.

SUMMARY OF THE INVENTION

Generally speaking, in accordance with the invention, a method and apparatus are provided for replenishing depleted portions of an ink layer of an ink sheet from which ink has been transferred, without unintentionally supplying ink to undepleted portions of the ink layer. To accomplish the foregoing, an ink sheet formed with an insulating layer and a conductive ink layer disposed on the insulating layer is provided. Electrically conductive replacement ink is charged and disposed on an intermediate member such as a roller. The intermediate member includes a dielectric surface over an electrically conductive layer. Charge is supplied to the insulating layer side of the ink sheet and replacement ink on the intermediate roller contacts the ink layer side of the ink sheet. Replacement ink then transfers from the intermediate roller to depleted portions only of the ink sheet by electrostatic attraction and not to undepleted portions.

Accordingly, it is an object of the invention to provide an improved method and apparatus for replenishing depleted portions of an ink layer of an ink sheet.

Another object of the invention is to provide an improved apparatus and method for replenishing a depleted ink layer of an ink sheet that is less complex than conventional methods and apparatuses.

A further object of the invention is to provide a method and apparatus for regenerating an ink sheet with high energy efficiency and low operating costs.

Still another object of the invention is to provide an improved method and apparatus for replenishing depleted portions of an ink sheet so that when the replenished ink sheet is used for printing. the resulting images will have high quality and high reproducability.

Still other objects and advantages of the invention will in part be obvious and will in part be apparent from the specification and drawings.

The invention accordingly comprises the several steps and the relation of one or more of such steps with respect to each of the others and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
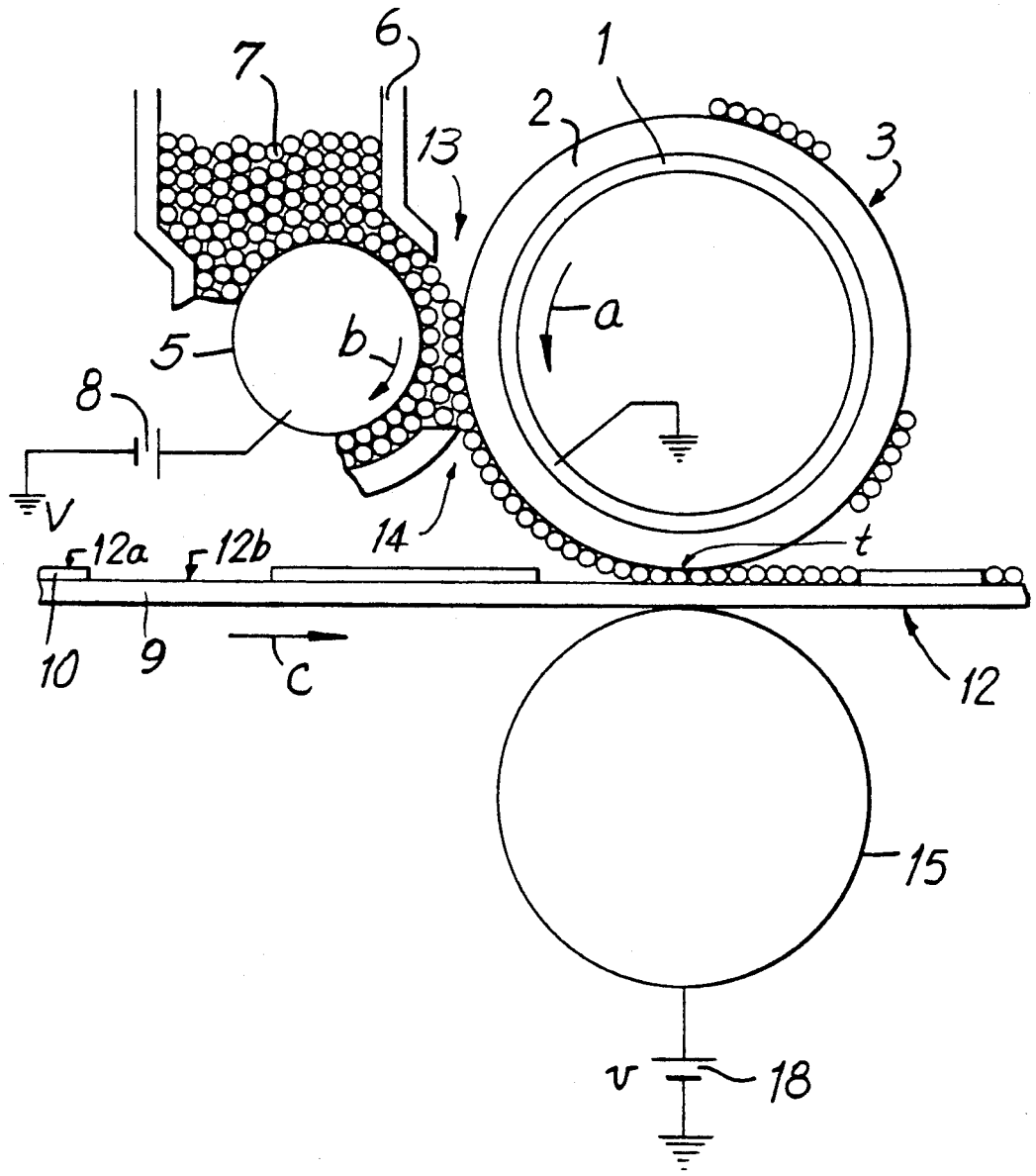
FIG. 1 is a cross-sectional schematic view of an apparatus for replenishing an ink sheet constructed in accordance with an embodiment of the invention.

Depleted portions of an ink layer of an ink sheet are replenished by selectively supplying replacement ink to the depleted portions from which ink has been printed and not to unrecorded portions of the ink layer. The resulting replenished ink layer is uniform, smooth and highly reproducible.

One method for replenishing depleted portions of an ink sheet with replacement ink employs an ink sheet including a conductive ink layer on a dielectric layer or substrate. After portions of the ink layer have been transferred, conductive replacement ink on an electrode is supplied to the ink sheet and an electric charge is induced in the replacement ink directly from the electrode. Opposite charges are induced on the opposite side of the dielectric layer side of the ink sheet. Replacement ink that contacts the dielectric layer from the ink layer side at voids in the ink layer will adhere to the dielectric layer of the ink sheet. However, charges in replacement ink contacting non-transferred ink regions will flow to the conductive ink layer and replacement ink will not adhere to the non-transferred regions. This method is discussed more fully in the inventors' U.S. Pat. No. 4,942,056, the contents of which are incorporated herein by reference.

In a more preferred embodiment of the invention, an ink sheet is provided that has electrically conductive ink disposed on an insulating substrate. During printing, ink is transferred from this ink layer to create depleted regions or portions. Replacement ink is supplied to the depleted portions by first charge inducing or charge injecting electrically conductive replacement ink onto an intermediate member, such as a roller having an electrically conductive layer with a dielectric layer formed thereon. The charged replacement ink adheres to the intermediate roller by electrostatic force. Charge is then supplied to the insulating layer side of the ink sheet and replacement ink from the intermediate roller is transferred to depleted portions only of the ink sheet by electrostatic force. The charge to the insulating layer side is made sufficient to remove replacement ink contacting the depleted portions from the intermediate roller. Replacement ink contacting the conductive ink layer at non-depleted portions will not adhere to the ink sheet.

In a preferred embodiment of the invention, the electrically conductive replacement ink is in the form of a powder and has a volume-mean particle size of from about 5 to 50 μm. In another preferred embodiment, replacement ink and residual charge remaining are removed from the intermediate roller after ink is replenished. In another embodiment, a photo-electrically conductive layer can be used as the dielectric layer of the intermediate roller. The photo-electrically conductive layer is insulating unless it is irradiated with a specific wavelength range of light and it then becomes conductive.

Electrically conductive replacement ink is charged by charge-injection and adheres to the dielectric layer of the intermediate roller by electrostatic force. Charge is also supplied to the insulating layer side of the ink sheet (the back side of the ink sheet). The ink-layer side of the ink sheet will be conductive at non-printed portions because the ink layer is electrically conductive and insulating at depleted portions from which the conductive ink was removed because the insulating layer will be exposed. The electrically conductive replacement ink becomes polarized and has a charge $Q_1$ at the intermediate roller and a charge of $Q_2$ at the ink sheet. The restricting force F of the replacement ink to the intermediate roller and the adhering force f of the replacement ink to the ink sheet can be shown as:

$$F = k_1 Q_1^2 / D^2$$

$$f = k_2 Q_2^2 / d^2$$

wherein $k_1$ and $k_2$ are constants, D is the membrane thickness of the dielectric layer of the intermediate roller, and d is the membrane thickness of the insulating layer of the ink sheet.

When adhering force f of replacement ink to the ink sheet is greater than restricting force F of replacement ink to the intermediate roller, replacement ink will adhere to and replenish the ink sheet. Replacement ink in contact with the electrically conductive non-depleted portion of the ink sheet releases charge $Q_2$ to the conductive ink layer and therefore does not have the adhering force f. Accordingly, replacement ink contacting undepleted portions of the ink sheet will not adhere to the ink sheet at undepleted portions. In this manner, replacement ink will be selectively transferred only to depleted portions of the ink layer.

It can be beneficial to remove replacement ink remaining on the intermediate roller which was not transferred to the ink sheet during the replenishing step and to remove the charge of the intermediate roller. This aids in controlling the quantity of replacement ink adhering to the intermediate roller and leads to more uniform performance of the method. Charge can be removed with conventional grounded contacting devices or by devices which supply opposite charge to the intermediate roller.

In another embodiment of the invention, the intermediate roller is formed with a photo-conducting layer on the conducting layer. When a photo-conducting layer is not irradiated with light, it acts as a dielectric layer. Therefore, the electrically conductive replacement ink can be selectively transferred to depleted portions of the ink layer as described above. Subsequent irradiation of the photo-conductive layer can then eliminate residual charge on the surface of the intermediate roller.

By employing conductive powder ink as the replacement ink, the powdered ink can be selectively adhered to depleted portions in substantially a single layer so that the quantity of replacement ink can be effectively controlled. Because the replacement ink is held to the intermediate roller by electrostatic forces, either magnetic or non-magnetic ink can be employed.

Replenishment of ink sheets in accordance with preferred embodiments of the invention will be described in greater detail in the following examples. These examples are set forth for purposes of illustration only and are not intended to be construed in a limiting sense.

EXAMPLE 1

FIG. 1 is a schematic view of an ink replenishing apparatus 100 constructed in accordance with a preferred embodiment of the invention. Apparatus 100 includes an intermediate roller 3 for applying a quantity of replacement ink 7 stored in a hopper 6 to a depleted ink sheet 12. Intermediate roller 3 includes at least an outer dielectric layer 2 disposed on an electrically conductive layer 1 and rotates in the counter-clockwise direction of an arrow a. A rotating ink electrode 5 in contact with electrically conductive replacement ink 7 is positioned a fixed distance from intermediate roller 3 and rotates in the clockwise direction of arrow b. Ink electrode 5 supplies replacement ink 7 to intermediate roller 3 at an opening 13 in hopper 6 which is positioned so that there is a gap 14 between intermediate roller 3 and ink electrode 5.

A voltage V is applied between electrically conductive layer 1 of intermediate roller 3 and ink electrode 5 by a power source 8 coupled to ink electrode 5. Voltage V creates an electric path from ink electrode 5 across gap 14 to intermediate roller 3 through replacement ink 7. A charge q is supplied to electrically conductive replacement ink 7 which is in contact with dielectric layer 2. Replacement ink 7 which only contacts other electrically conductive particles of replacement ink 7 becomes a passage for charge (electricity passage) and does not itself hold the charge. Only replacement ink 7 in contact with intermediate roller 3 adheres to intermediate roller 3 by electrostatic force.

An ink sheet 12 including an insulating layer 9 with an ink layer 10 disposed thereon travels in the direction of an arrow c past intermediate roller 3 and in contact therewith at an ink transfer position t. Ink sheet 12 includes conductive non-depleted ink regions **12*a* formed of non-transferred ink regions of ink layer 10 and depleted ink regions 12*b* with exposed surfaces of insulating layer 9. As depleted ink regions 12*b* pass intermediate roller 3 at transfers position t, replacement ink 7 is deposited onto the exposed surface of insulating layer 9 and replenishes depleted portions 12*b* to regenerate ink layer 10**.

An ink sheet electrode 15 is positioned on the insulating side of ink sheet 12 at transfer position t to transfer replacement ink 7 electrostatically to depleted regions **12*b*. A voltage v is applied to ink sheet electrode 15 to apply voltage v between electrically conductive layer 1 of intermediate roller 3 and ink sheet electrode 15. Voltage v is applied by a power source 18 coupled to ink sheet electrode 15. Ink sheet electrode 15 contacts insulating layer 9 of ink sheet 12 at transfer position t so that conductive replacement ink 7 is between ink sheet 12 and intermediate roller 3**.

Electrically conductive replacement ink 7 which contacts depleted regions **12*b* of ink sheet 12** has a charge:

$$Q_{total}=Q_1-Q_2$$

wherein $Q_{total}$ is determined by voltage V, voltage v, electrostatic capacity C of dielectric layer 2 and the electrostatic capacity c of insulating layer 9. The charge induced to electrically conductive layer 1 of intermediate roller 3 is represented as $-Q_1$ and the charge induced to ink sheet electrode 15 is represented by $Q_2$.

The restricting force F of replacement ink 7 to intermediate roller 3 and the adhering force f of replacement ink 7 to ink sheet 12 are shown as:

$$F=k_1Q_1^2/D^2$$

$$f=k_2Q_2^2/d^2$$

wherein $k_1$ and $k_2$ are constants, D is the membrane thickness of dielectric layer 2 and d is the membrane thickness of insulating layer 9 When adhering force f to ink sheet 12 is greater than restricting force F, replacement ink 7 transfers to ink sheet 12 to replenish depleted regions **12*b*. Accordingly, by properly selecting voltage V applied to ink electrode 5, voltage v applied to ink sheet electrode 15, capacitance C of dielectric layer 2 and capacitance c of insulating layer 9, replacement ink is selectively transferred to depleted portions 12*b* of ink sheet 12**.

Electrically conductive replacement ink 7 contacts electrically conductive undepleted regions **12*a* has charge $Q_1$ and is sufficiently retained on to intermediate roller 3 by electrostatic force. Undepleted regions 12*a* have a charge $Q_2$. In this manner, replacement ink 7 will not be undesirably transferred to undepleted regions 12*a*. It is often desirable to fix replacement ink 7 transferred to depleted regions 12*b*** with a fixing device such as a heated roller to regenerate the ink sheet.

In a preferred embodiment of the invention, dielectric layer 2 is formed of materials having a volume resistivity of $10^{12}\Omega\cdot$cm or more. Acceptable materials include fluororesin, polyester polyaramid, $SiO_2$, SiC, $Si_3N_4$ and also materials having poor wetting properties with respect to the replacement ink is such as fluororesin. Ink electrode 5 should be formed with a slightly coarse surface in order to supply the electrically conductive ink to the intermediate roller easily.

Electrically conductive replacement ink 7 preferably contains at least one type of electrically conductive agent such as a carbon black such as furnace black or acetylene black; metal oxides such as ITO powder or $SnO_2$ powder; metal powders such as Ag powder or Al powder; salts such as quaternary ammonium salt; and electrically conductive resins such as polyacetylene or polypyrol. Replacement ink 7 can also contain substances from the following groups of substances.

1. Single or complex substances selected from the following compounds: waxes such as candelilla wax, carnauba wax, rice wax, beeswax, lanolin, montan wax, ozocerite, paraffin wax, microcrystalline wax, perotolatam, polyethylene wax, Fischer Tropsch wax, montan wax derivative, paraffin wax derivative, hardened castor oil, synthesized wax, higher fatty acids such as stearic acid, palmitic acid, polyolefins such as low molecular polyethylene, polyethylene oxide, polypropylene, types of olefin copolymer such as ethylene, acrylic acid copolymer, ethylene acrylate copolymer, and ethylene-vinyl acetate copolymer.

2. Single body, copolymer or complex resins selected from types of acrylic resins such as polyacrylate and polymethacrylate; styrene resins such as polystyrene and poly-1-methyl styrene; and thermoplastic resins such as butyryl resin, polyvinyl chloride, polyvinylidene chloride, polyvinyl-fluoride, polyvinylidene fluoride, polyester resin, polycarbonate resin, cellulose resin, polyallylate resin, polyethylene resin.

3. Single, copolymer, or complex resins selected from aqueous resins such as polyvinyl alcohol, polyallyl alcohol, polyvinyl pynolidone, polyvinyl amine, polyallyl amine, polyvinyl acrylic acid, polyvinyl methacrylic acid, polyvinyl sulfonic acid, polylatic acid, casein, hydroxypropylcellulose, starch, gum arabic, polyglutamic acid, polyaspartic acid and nylon resin.

4. Resins selected from thermosetting resins such as epoxy resin, silicone resin, urethane resin, melamine resin and alkyd resin.

5. Coloring agents such as black dyes or pigments such as furnace black, lampblack, acetylene black and nigrosine; cyan dyes such as copper-phthalocyanine; magenta dyes such as carmine 6B and yellow dyes such as disazo yellow.

6. Magnetic powders such as $Fe_3O_4$, $Fe_2O_3$, Fe, Cr, Ni.

7. Surfactants or dispersing agents such as metal soap and polyethylene glycol.

8. Static-control agents such as electron-accepting organic complexes, polyester chloride, nitrophnic acid, quaternary ammonium salt and pyridinium salt.

9. Fillers such as talc.

10. Fluid-improving agents such as $SiO_2$, $TiO_2$.

The preferable volume resistivity of replacement ink 7, calculated by the pressure-cell-resistance-value method in the state of applying voltage of 5V/mm under a pressure of 10 kg/cm$^2$, is $10^8\Omega$·cm or less, more preferably $10^5\Omega$·cm or less. Replacement ink 7 can be powder, paste, melted and dissolved ink, half-melted and half-dissolved ink. It is powder ink that is shown in the drawings.

The ink sheet may contain at least conductive ink layer 10 on an insulating layer 9. Insulating layer 9 may be composed of multiple layers, and insulating layer 9 and ink layer 10 may be multi-layered on an electrically conductive support. A heat-resistant layer, an abrasion-resistant layer and so forth can be formed at the back side of ink layer 10. Furthermore, insulating layer 9 is preferably formed of a material that is easily formed onto a film such as polyester, polysulfone, polyimide and polyaramid. The volume resistivity of the ink layer is preferably $10^{10}\Omega$·cm or less, more preferably to be $10^8\Omega$·cm or less.

The charge-injected electrically conductive ink is adhered by electrostatic force to intermediate roller 3. After supplying replacement ink 7 onto intermediate roller 3, charge can be supplied and injected by corotron for example, in addition to the methods shown in the examples to follow.

To supply charge to the side of insulating layer 9 of ink sheet 12, apparatus 100 includes ink sheet electrode 15 which is in contact with the insulating layer 9 of ink sheet 12 and applies voltage between electrically conductive layer 1 of intermediate roller 3 and ink sheet electrode 15. However, charge can be supplied to insulating layer 9 of ink sheet 12 by corotron and so on.

A fixing device to fix replacement ink 7 to ink sheet 12 is especially desirable when replacement ink 7 is a powder. In the case of paste ink, melted and dissolved ink, half-melted and half-dissolved ink, the fixing device is not always required. Replacement ink 7 can be fixed to ink sheet 12 by pressing against the back of ink sheet 12 with a roller heated by a built-in lamp, passing the ink sheet between a roller heated by a built-in lamp and a metal roller, irradiating with a lamp from the ink layer side and passing the ink sheet between two pressed-metal rollers.

Figure 2:
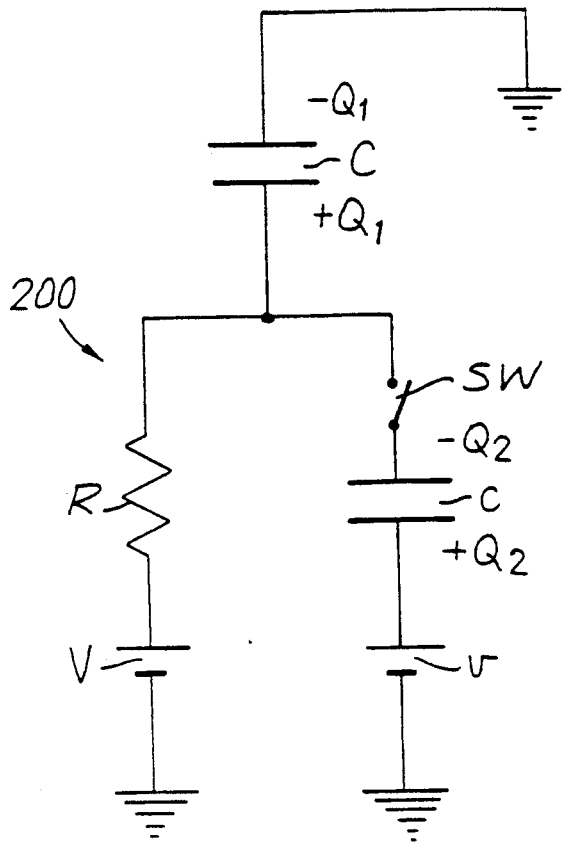
FIG. 2 is an equivalent circuit for the apparatus of FIG. 1.

To determine appropriate voltages V and capacitances C and c to adhere and replenish replacement ink securely to depleted portion **12*b* of ink sheet 12, a CR equivalent circuit 200 of apparatus 100 was derived and is shown in FIG. 2. Circuit 200 shows capacitance C; capacitance c; charge $-Q_1$ to electrically conductive layer 1; charge $Q_2$ to ink sheet electrode 15; voltage V; voltage v; resistivity R of the electric path from ink electrode 5 to ink sheet 12 formed by conductive replacement ink 7 on intermediate roller 3; and a switch SW, which is closed when replacement ink 7 contacts ink sheet 12** (at t=0).

$Q_{total}$ of replacement ink 7 is:

$$Q_{total}=Q_1-Q_2,$$

and at t=0, it is to be $Q_{total}(t=0)=CV$

When $t\geqq 0$, $(C+c)R<1$, and $Q_1$, $Q_2$ is solved, i.e., $$Q_1=CF$$

$$Q_2=c(v-V)$$

At this condition, it is necessary that adhering force f to ink sheet 12 is greater than restricting force F to roller 3—f>F is satisfied in order to adhere and replenish replacement ink 7 onto ink sheet 12.

Figure 3:
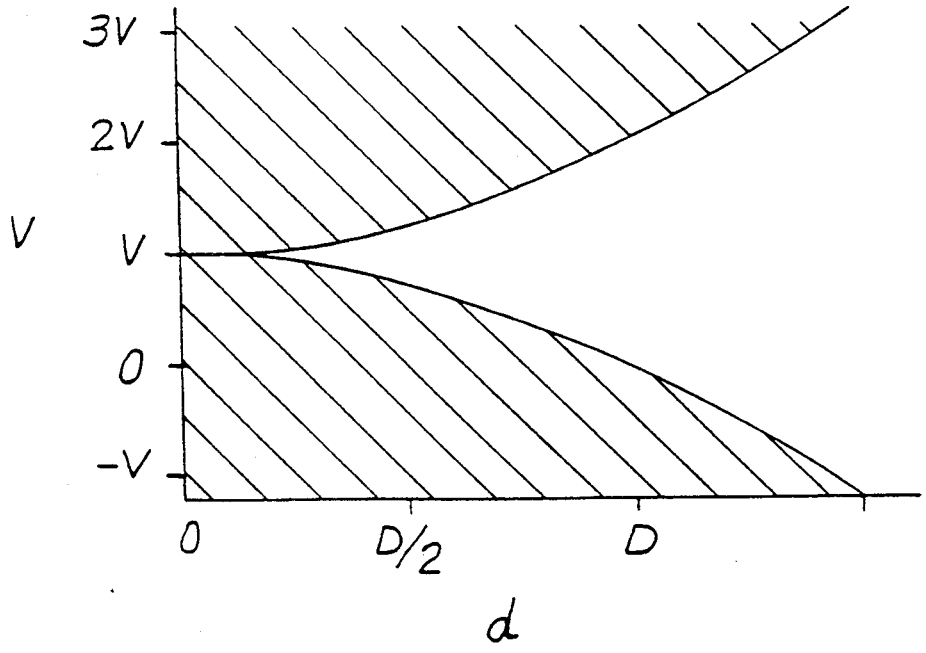
FIG. 3 is a graph showing the relationship between voltage and membrane thickness for adhering replacement ink to an ink sheet with the apparatus shown in FIG. 1.

If membrane thickness D of dielectric layer 2, membrane thickness d of insulating layer 9 and the dielectric constant of dielectric layer 2 and the dielectric constant of insulating layer 9 is equivalent in order to simplify the calculation, to satisfy f>F (V and D as parameters) v and d should be in the shaded portion of the graph shown in FIG. 3. The vertical line of the graph of FIG. 3 shows voltage v, and the horizontal axis shows membrane thickness d of insulating layer 9.

When replacement ink 7 contacts undepleted regions **12*a* (though releasing charge $Q_2$ to ink layer 10) ink 7 has charge $Q_1$ and remains adhered to intermediate roller 3 by electrostatic force and is not transferred to ink sheet 12. By selecting v and d to be in the shaded portion of FIG. 3, the regeneration of ink sheet 12 was carried out and replacement ink 7 was adhered selectively only to depleted portion 12*b* of ink sheet 12**.

When using electrically conductive powder replacement ink 7 and equalizing the circular velocity of intermediate roller 3 and ink sheet 12, powder ink 7 was adhered and filled adequately the depleted portions of ink sheet 12 in substantially a single layer. This is desirable because the selectivity of the adhesion and the adhering amount can both be controlled.

EXAMPLE 2

Figure 4:
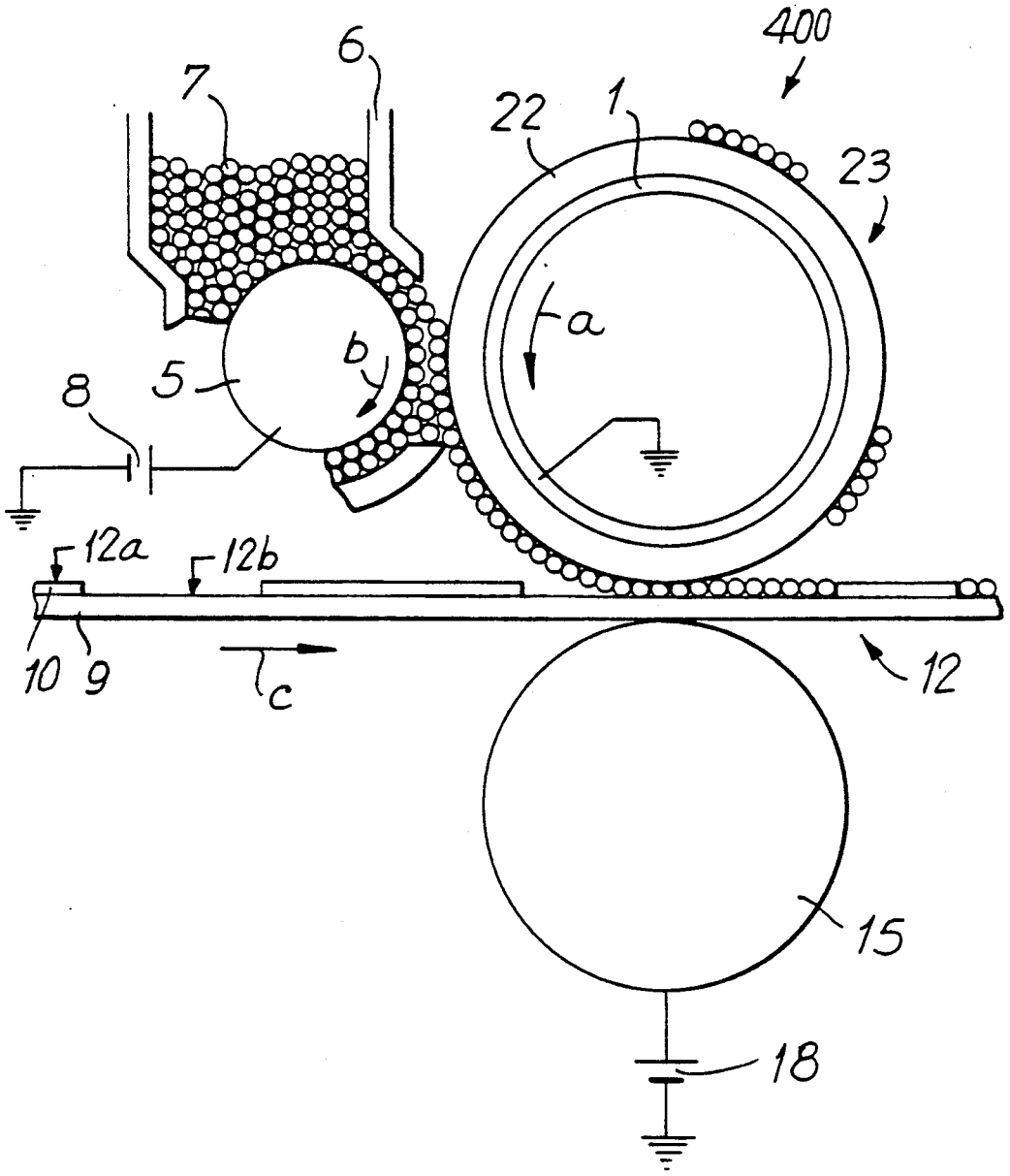
FIG. 4 is a cross-sectional schematic view of an apparatus for replenishing a depleted ink sheet constructed in accordance with another embodiment of the invention.

FIG. 4 shows a schematic view of an ink sheet replenishing apparatus 400 including the elements of apparatus 100, but with a different intermediate roller 23 having a photo-electrically conductive layer 22 on conductive layer 1. Throughout the application, identical elements depicted in the figures are assigned the same reference numerals. When not irradiated, photoelectrically conductive layer 22 operates similarly to dielectric layer 2 and roller 23 operates as does roller 2 of apparatus 100. Photoelectrically conductive layer 22 may be either single layer-type or multi-layer-type and the volume resistivity of photo-electrically conductive layer 22 is preferably $10^{12}\Omega$·cm or less when not irradiated with light within the sensitivity range of layer 22.

EXAMPLE 3

Figure 5:
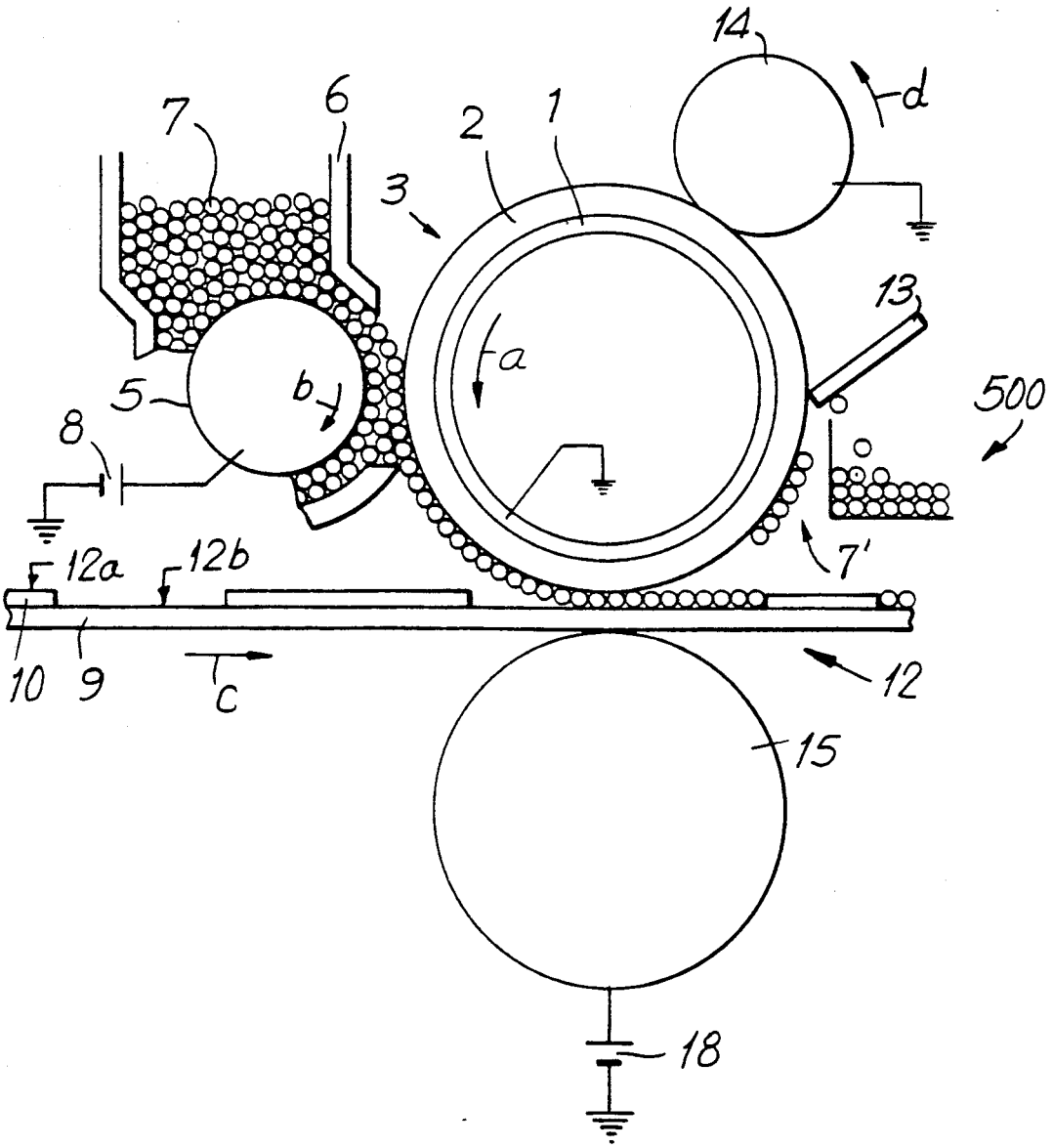
FIG. 5 is a cross-sectional schematic view of an apparatus for replenishing depleted portions of an ink sheet constructed in accordance with another embodiment of the invention.

FIG. 5 shows a schematic view of an ink sheet replenishing apparatus 500 containing the elements of apparatus 100 and also including an excess ink removal blade 13 contacting intermediate roller 3 to remove excess replacement ink 7' remaining on roller 3. Apparatus 500 also includes a grounded charge removing roller 14 which returns the surface charge of dielectric layer 2 to zero after removal of excess ink. Charge removing roller 14 rotates in the direction of an arrow d.

Acceptable substances for blade 13 includes resins having relatively low hardness such as gums (urethane gum and silicone gum) and elastomers (urethane-type and fluororesin-type). Alternatively, excess ink can be removed with a tacky roller, a tacky substance or with suction.

To remove charge, other devices besides a charge removing roller 14 can be used. For example, a roller or other device can impart opposite charge to neutralize layer 2. Alternatively, irradiating with a DC corona device for irradiating with charge having opposite polarity to the charge remaining on the dielectric layer can be employed.

Charge removing roller 14 can also be an electrically conductive roller, the volume resistivity of which should be $10^8\Omega\cdot$cm or less. A roller formed of electrically conductive gum having a relatively low hardness at the surface, such as CR-type gum, NBR-type gum and SI-type gum is preferred.

The effects of removing replacement ink and of removing charge were investigated. Apparatus 500 shown in FIG. 5 was utilized to investigate and evaluate the state of adhesion of electrically conductive ink 7 to intermediate roller 3.

Operation (1): Not removing ink 7 remaining on intermediate roller 3 nor removing electric charge.

Operation (2): Removing ink 7 remaining on intermediate roller 3 but not removing electric charge.

Operation (3): Not removing ink 7 remaining on intermediate roller 3 but removing the electric charge.

Operation (4): Removing both ink 7 remaining on intermediate roller 3 and the electric charge.

The results are summarized below in Table 1.

TABLE 1

| Operation | State of adhesion |
|---|---|
| (1) | Unevenness of adhering generated |
| (2) | The adhered amount decreased |
| (3) | Experiment cannot be carried out |
| (4) | Good (the same adhering amount) |

Electric current is sent from ink electrode 5 to electrically conductive gum roller 14 through electrically conductive replacement ink 7 when carrying out charge-removing by a contact system of electrically conductive gum roller 14. Accordingly, when carrying out charge removal with electrically conductive replacement ink 7' still remaining, the charge of electrically conductive replacement ink 7 losing the adhering force to intermediate roller 3 is eliminated at the same time because ink 7 is dispersed.

When not removing replacement ink 7' and/or not removing charge, defects of the ink sheet affecting image quality such as lack of a complete ink layer occurred. When removing excess ink 7' and the residual charge, the adhesion of the electrically conductive ink onto the intermediate roller was effected more accurately with high reproductability. The number of times the ink sheet could be acceptably re-used was increased.

EXAMPLE 4

Figure 6:
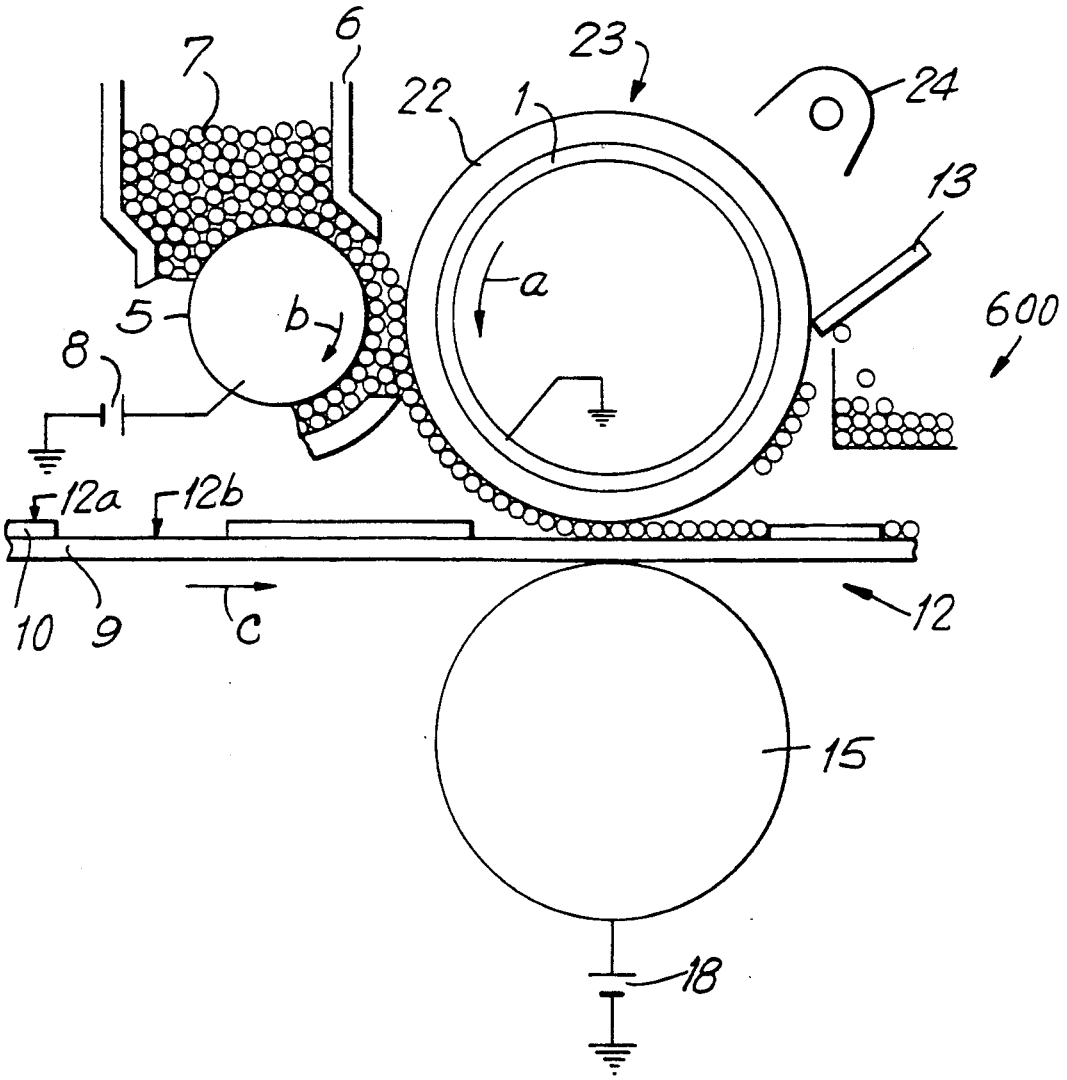
FIG. 6 is a cross-sectional schematic view of an apparatus for replenishing depleted portions of an ink sheet constructed in accordance with another embodiment of the invention.

FIG. 6 shows a schematic view of an ink replenishing apparatus 600 which includes the elements of apparatus 400 as well as blade 13 and a charge removing lamp 24.

Charge-removing lamp 24 includes a light source for irradiating with a wave length within the sensitivity range of photo-electrically conductive layer 22 of intermediate roller 23. Conductive layer 1 is grounded and when layer 22 is irradiated by lamp 24, layer 24 becomes conductive. Accordingly, charge remaining on roller 23 will be eliminated.

By removing both excess replacement ink 7' and charge, the adhesion of ink 7 onto intermediate roller 23 can be carried out more accurately with high reproducability. Accordingly, deterioration of image quality did not occur with repeated use of ink sheet 12.

EXAMPLE 5

Figure 7:
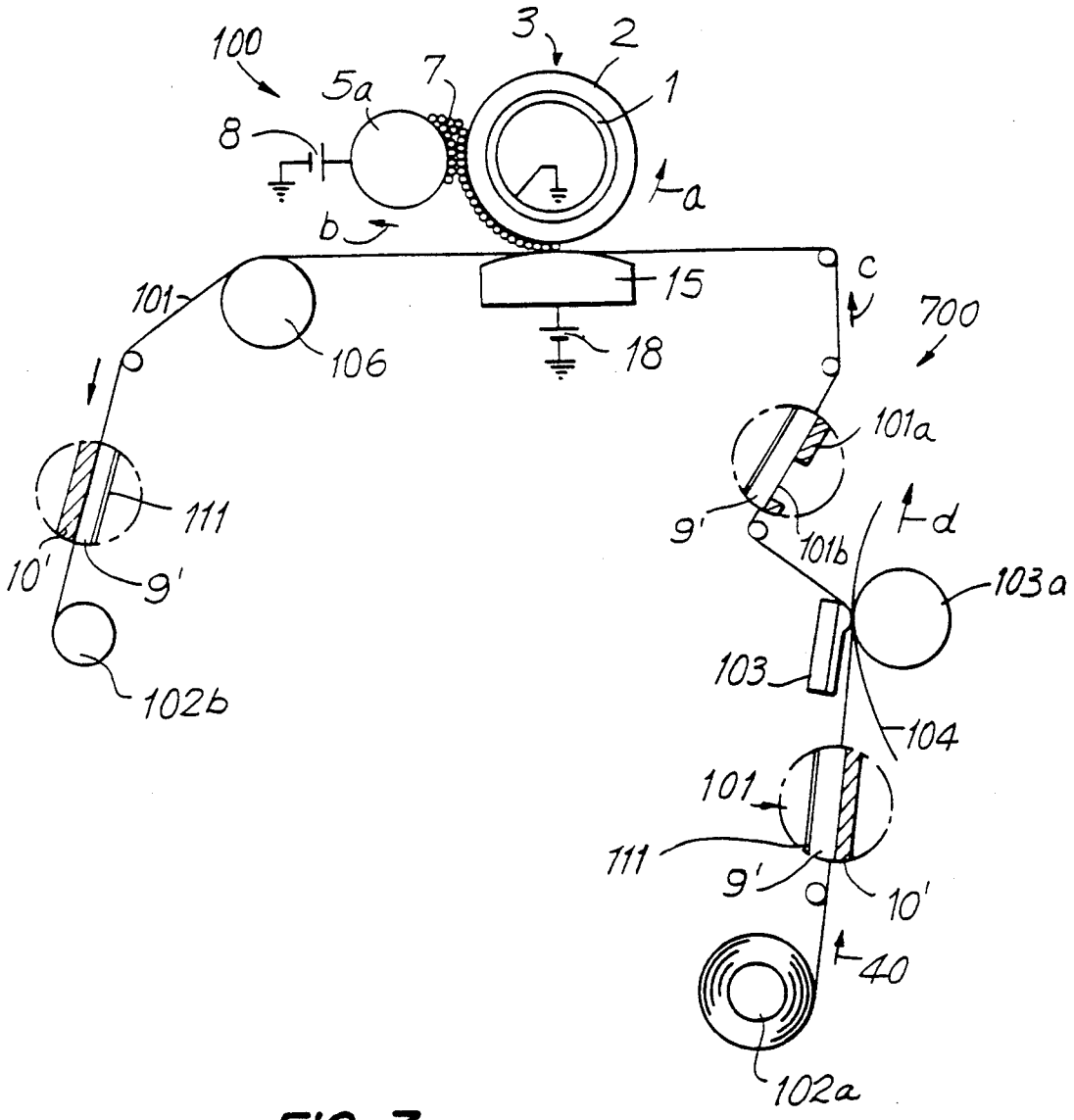
FIG. 7 is a cross-sectional schematic view of an image forming apparatus including an ink sheet regenerating apparatus constructed in accordance with another embodiment of the invention.

FIG. 7 illustrates in schematic view an image-forming apparatus 700 including ink replenishing apparatus 100 for regenerating an ink sheet 101. Ink sheet 101 includes an ink layer 10' which is disposed on one surface of an insulating substrate 9' with a heat-resistant layer on the opposite surface.

Ink sheet 101 travels in the direction of arrow 40 from a take-up roller **102*a* between a thermal print head 103 and a print roller 103*a*. Alternatively, an electric print head can be used. An image corresponding to an image signal is formed on a recording medium 104 moving between print head 103 and roller 103*a* in the same direction and at the same rate as ink sheet 101. After image formation occurs, ink sheet 101 includes undepleted regions 101*a* and depleted regions 101*b* in which the surface of insulating layer 9' is exposed. Ink sheet 101 travels further in the direction of arrow c to ink replenishing apparatus 100 and depleted portions 101*b* are replenished with replacement ink 7. Apparatus 700 also includes a heater 106 arranged to contact heat resistant layer 111 of ink sheet 101 to fix powder replacement ink 7 to ink sheet 101. In this manner, ink sheet 101 is regenerated and rolled onto a take-up roller 102*b*** and can be re-used.

EXAMPLE 6

Figure 8:
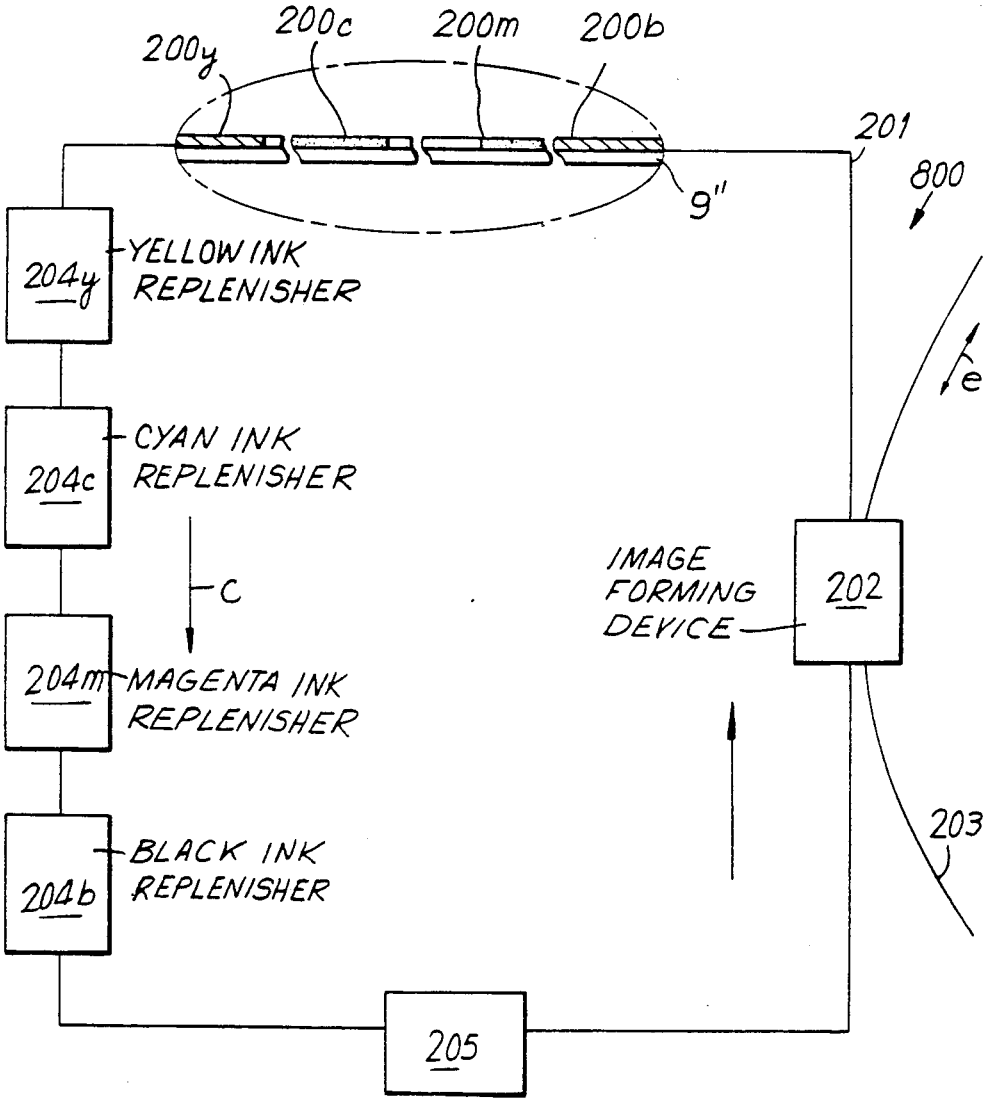
FIG. 8 is a schematic view of an image forming apparatus including an ink sheet regenerating apparatus constructed in accordance with another embodiment of the invention.

FIG. 8 is a schematic diagram of an ink transfer apparatus 800 for printing with and replenishing an endless multi-color ink sheet 201. Ink sheet 201 includes a yellow ink portion **200*y*, a cyan ink portion 200*c*, a magenta ink portion 200*m* and a black ink portion 200*b*, all on an insulating layer 9''. Endless ink sheet 201 travels in the direction of an arrow c. An image forming device 202 transfers ink in the form of an image of up to each color corresponding to an image signal onto a recording medium 203** which moves back and forth in the direction of a double arrow e.

To replenish ink sheet 201, apparatus 800 includes a series of ink replenishing devices **204*y*, 204*c*, 204*m* and 204*b*, each constructed in accordance with the invention for selectively replenishing each color of y, c, m and b. Each device can include a built-in color-sensor. The ink is then fixed with two fixing devices 205**. In this way, image-forming and ink sheet regenerating are carried out continuously. Image-forming and regenerating of the ink sheet was carried out and unacceptable deterioration of image quality by repeated use of the ink sheet did not occur.

EXAMPLE 7

Figure 9:
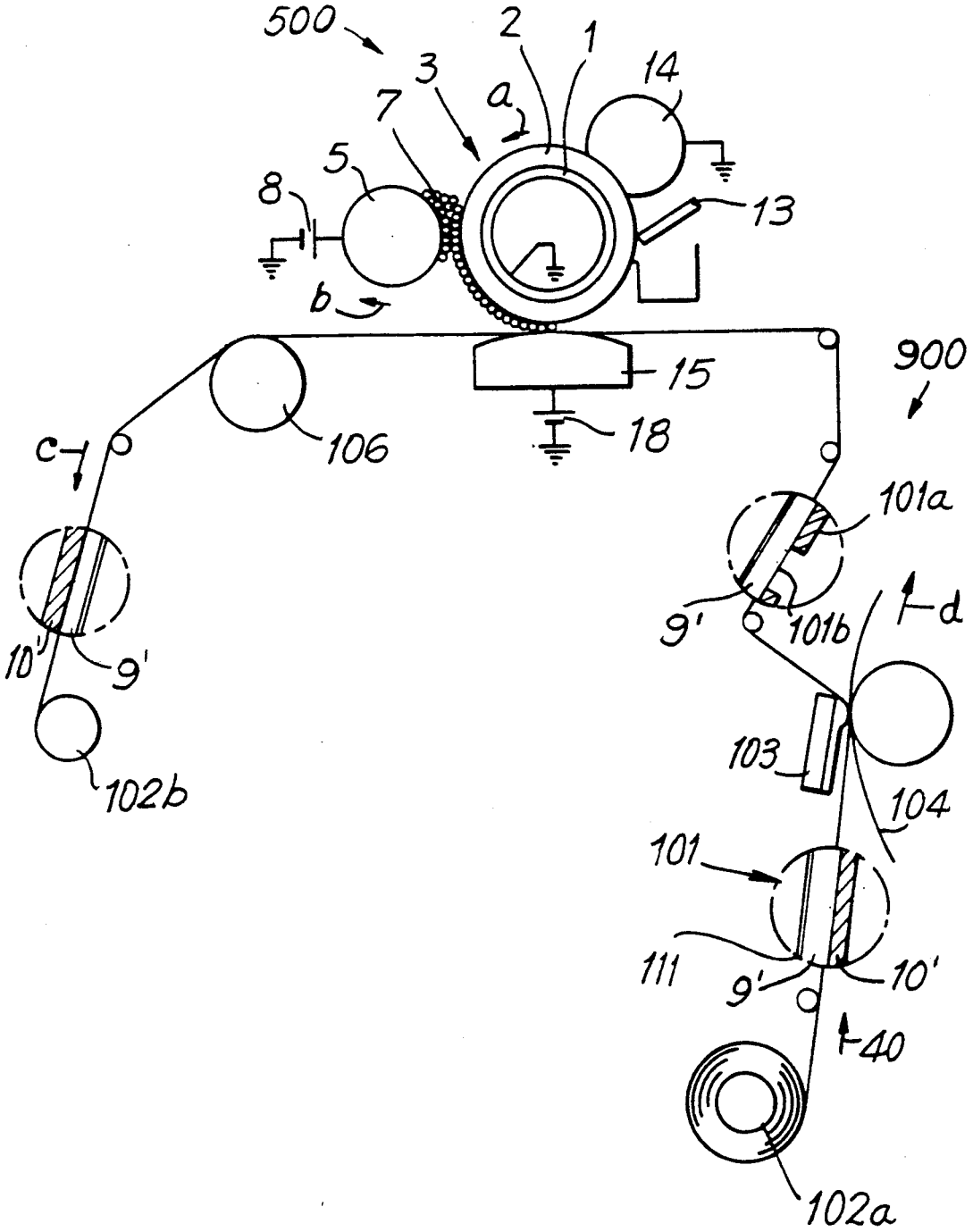
FIG. 9 is a schematic view of an image forming apparatus including the ink sheet regenerating apparatus of FIG. 5.

FIG. 9 is a schematic diagram of an image forming apparatus 900 including ink sheet replenishing device 500. Ink sheet 101 is used to transfer images to recording medium 104 and thus create depleted portions **101*b*** and undepleted portions 101*a*. Undepleted portions 101*b* are filled in by ink replenishing apparatus 500 which includes blade 13 for removing excess replacement ink 7 and a charge removing roller 14. Ink sheet 101 continues to travel in the direction of arrow c, the replaced ink is fixed with a heating device 106 and the regenerated ink sheet is collected on take-up roller 102*b*. Repeated use of ink sheet 101 did not lead to unacceptable changes in image quality.

EXAMPLE 8

Figure 10:
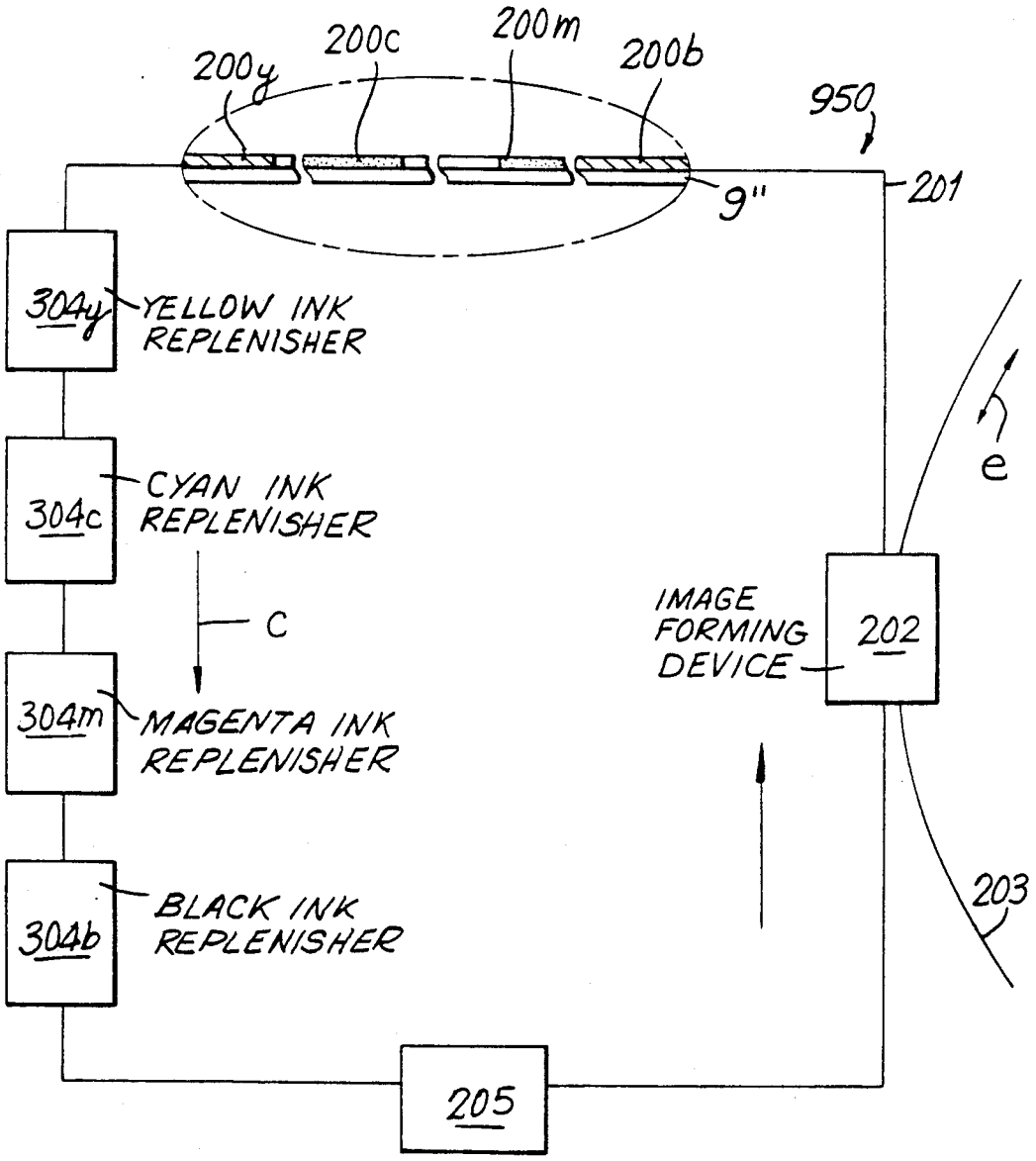
FIG. 10 is a schematic view of an image forming apparatus including the ink sheet regenerating apparatus shown in FIG. 5.

FIG. 10 shows an image transfer apparatus 950 for transferring ink from endless ink sheet 201 as described in Example 6 and shown in FIG. 8. Apparatus 950 differs from apparatus 800 of FIG. 8 by employing ink replenishing devices 304*y*, 304*c*, 304*m* an 304*b* for replenishing yellow, cyan, magenta and black ink, respectively with an apparatus similar to apparatus 500 shown in FIG. 5. Image forming and ink sheet replenishing were carried out repeatedly and deterioration of image quality was not observed.

In accordance with the invention, an ink sheet can be used numerous times to form images. The operating cost of the image forming apparatus is thereby lowered. Because the force holding replacement ink to the intermediate roller is electrostatic force, both magnetic and non-magnetic ink can be employed. Even after the ink sheet is regenerated numerous times, images without deterioration of quality (maximum 0. D. value, reproduction of narrow lines, color reproduction) are formed. Furthermore, by regenerating a used ink sheet, a negative image does not remain on the ink sheet and security and secrecy can be improved. An ink sheet regenerating apparatus in accordance with the invention is especially useful when employed with an image forming apparatus such as a printer, video printer, facsimile, copying machine, display and so on.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A method of replenishing an ink transfer sheet including an electrically conductive ink layer on an insulating substrate after portions of the ink layer have been removed during printing to create depleted regions in the ink layer, comprising:

supplying charged electrically conductive replacement ink adhering to an intermediate member by electrostatic force, the intermediate member having an electrically conductive layer and an outer surface of a dielectric layer on the electrically conductive layer;

contacting charged replacement ink adhered to the intermediate member with the ink layer of the ink sheet including the depleted regions;

supplying sufficient charge to the insulating substrate side of the ink sheet to overcome the electrostatic attraction of the replacement ink to the intermediate member at the depleted regions and selectively replenishing the depleted regions of the ink layer with replacement ink from the intermediate member by electrostatic force.

2. The ink replenishing method of claim 1, including supplying replacement ink in the form of a powder with a volume-mean particle size of from about 5 to 50 μm.

3. The ink replenishing method of claim 1, including removing replacement ink remaining on the intermediate member after contacting the ink sheet.

4. The ink replenishing method of claim 1, including the step of returning the surface charge of a portion of the intermediate member to zero, after that portion of the intermediate member has contacted replacement ink to the ink sheet.

5. The ink replenishing method of claim 3, including removing any electrical charge remaining on the intermediate member at portions that contacted the ink sheet.

6. The ink replenishing method of claim 1, wherein the ink sheet includes a plurality of colored ink sections and each colored ink section is replenished with ink of the color of the section.

7. The ink replenishing method of claim 5, wherein the ink sheet includes a plurality of colored ink sections and each colored ink section is replenished with ink of the color of the section.

8. The ink replenishing method of claim 1, including supplying replacement ink to the intermediate member by disposing a supply electrode in a supply of replacement ink, the replacement ink supply disposed between the supply electrode and the intermediate member, and applying a voltage between the supply electrode and the conductive layer of the intermediate member so that ink contacting the dielectric layer becomes charged and adheres to the dielectric layer.

9. The ink replenishing method of claim 8, wherein the supply electrode is cylindrical and rotates in a supply of replacement ink.

10. The ink replenishing method of claim 8, wherein the ink is powdered ink and a single layer of powder is transferred to the depleted portion.

11. The ink replenishing method of claim 1, wherein the replacement ink added to the depleted regions is fixed to the ink sheet.

12. The ink replenishing method of claim 10, wherein the replacement ink added to the depleted regions is fixed to the ink sheet by application of heat and pressure.

13. The ink replenishing method of claim 1, wherein the replacement ink is powdered ink and is replenished to the depleted regions in a single layer.

14. The ink replenishing method of claim I, wherein the intermediate member is a roller.

15. A method of replenishing depleted regions of an ink transfer sheet including an electrically conductive ink layer on an insulating substrate after portions of the ink layer have been transferred to create depleted regions in the ink layer, comprising:

supplying charged electrically conductive replacement ink electrostatically adhered to an intermediate member having an electrically conductive layer and a photo-electrically conductive layer surface on the electrically conductive layer;

contacting the charged replacement ink adhered to the intermediate member to the ink layer including the depleted regions; and;

supplying sufficient charge to the insulating layer side of the ink sheet to overcome the electrostatic attractive force to the intermediate roller of replacement ink in contact with depleted portions and selectively replenishing replacement ink from the intermediate member to the depleted regions of the ink layer.

16. The ink replenishing method of claim 15, including supplying replacement ink in the form of a powder with a volume-mean particle size of from about 5 to 50 μm.

17. The ink replenishing method of claim 15, wherein the ink is powdered ink and is replenished to the depleted regions in a single layer.

18. The ink replenishing method of claim 15, including removing replacement ink remaining on the intermediate member and charge remaining on the intermediate roller after contacting the ink sheet.

19. The ink replenishing method of claim 15, including removing any electrical charge remaining on the intermediate member at portions that contacted the ink sheet.

20. The ink replenishing method of claim 18, including removing any electrical charge remaining on the intermediate member at portions that contacted the ink sheet.

21. The ink replenishing method of claim 15, wherein the ink sheet includes a plurality of colored ink sections and each colored ink section is replenished with ink of the color of the section.

22. The ink replenishing method of claim 15, including supplying replacement ink to the intermediate member by disposing a supply electrode in a supply of replacement ink the replacement ink supply disposed between the supply electrode and the intermediate member, and applying a voltage between the supply electrode and the conductive layer of the intermediate member so that ink contacting the dielectric layer becomes charged and adheres to the dielectric layer.

23. The ink replenishing method of claim 22, wherein the supply electrode is cylindrical and rotates in a supply of replacement ink.

24. The ink replenishing method of claim 22, wherein the ink is powdered ink.

25. The ink replenishing method of claim 15, wherein the replacement ink added to the depleted regions is fixed to the ink sheet.

26. An apparatus for replenishing the ink layer of an ink sheet including a layer of electrically conductive ink on an insulating substrate from which portions of the ink layer have been removed to create depleted regions in the ink layer, comprising:

ink supply means for holding replacement ink;

ink charging means for supplying charge to the ink of the ink supply means;

intermediate ink transfer means for receiving and electrostatically holding ink from the ink supply means including a conductive layer having an insulating layer disposed on the outer surface thereof facing the ink supply means;

ink sheet charge means for applying charge to the insulating substrate side of the ink sheet sufficient to remove ink by electrostatic force from the intermediate ink transfer means and selectively adhere the replacement ink to the depleted regions of the ink layer.

27. The apparatus for replenishing ink of claim 26, wherein the insulating layer of the intermediate ink transfer means is formed of photo-electrically conductive material that is in an insulating condition.

28. The apparatus for replenishing ink of claim 26, including ink in the form of a powder having a volume-mean particle size from about 5 to 50 μm.

29. The apparatus for replenishing ink of claim 26, including a supply electrode coupled to a voltage source to apply voltage between the supply electrode and the conductive layer of the intermediate ink transfer means contacting ink in the ink supply means so that the ink contacts with both the supply electrode and the insulating surface of the intermediate ink transfer means to charge and adhere the ink to the insulating layer by electrostatic force.

30. The apparatus for replenishing ink of claim 26, wherein the intermediate ink transfer means is a roller having a conductive layer with the insulating layer on the surface thereof.

31. The apparatus for replenishing ink of claim 29, wherein the ink supply means includes a roller having a conductive surface.

32. The apparatus for replenishing ink of claim 26, including ink removal means for removing ink on the intermediate ink supply means that was not transferred to the ink sheet.

33. The apparatus for replenishing ink of claim 26, including charge removal means for removing charge from portions of the intermediate ink transfer means after contacting ink to the ink sheet.

34. The apparatus for replenishing ink of claim 32, including charge removal means for removing charge from portions of the replacement ink transfer means that had contacted the ink sheet.

35. The apparatus for replenishing ink of claim 27, including ink removal means for removing ink on the intermediate ink transfer means that was not transferred to the ink sheet.

36. The apparatus for replenishing ink of claim 33, wherein the charge removal means includes a lamp capable of irradiating the photo-electrically conductive layer with light having a wave length which will make the photo-electrically conductive layer electrically conductive.

37. The apparatus for replenishing ink of claim 26, wherein the ink layer includes portions of different colors and the apparatus includes a supply of replacement ink for each color and is constructed to selectively replenish the depleted portions with ink having the same color as the ink that was removed from the depleted regions.

38. The apparatus for replenishing ink of claim 26, including non-magnetic ink.

39. The apparatus for replenishing ink of claim 26, including magnetic ink.

40. The apparatus for replenishing ink of claim 26, including ink that includes static control agents.

41. The apparatus for replenishing ink of claim 26, including ink that includes static control agents selecting from the group consisting of electron-accepting organic complexes, polyester chloride, nitrophnic acid, quaternary ammonium salts and pyridinium salts.

42. The apparatus for replenishing ink of claim 26, including ink having a volume resistivity of $10^8\Omega\cdot$cm or less.

43. The apparatus for replenishing ink of claim 26, including ink having a volume resistivity of $10^5\Omega\cdot$cm or less.

44. The apparatus for replenishing ink of claim 26, including fixing means for fixing the replenished ink to the ink sheet after ink replenishing.

45. The apparatus for replenishing ink of claim 26, wherein the fixing device includes a heated roller.

46. The apparatus for replenishing ink of claim 26, wherein the ink sheet is in the form of an endless sheet.

47. The apparatus for replenishing ink of claim 26, including powdered ink and the components of the apparatus are constructed and arranged to replenish the depleted regions with a single layer of powdered ink.

* * * * *